US006244919B1

(12) United States Patent
Valentini

(10) Patent No.: US 6,244,919 B1
(45) Date of Patent: Jun. 12, 2001

(54) VERTICAL AXIS AND TRANSVERSAL FLOW NAUTICAL PROPULSOR WITH CONTINUOUS SELF-ORIENTATION OF THE BLADES

(75) Inventor: Piero Valentini, Spoleto (IT)

(73) Assignee: S.P.N. S. R. L., Perugia (IT)

( * ) Notice: Subject to any disclaimer, the term of this patent is extended or adjusted under 35 U.S.C. 154(b) by 0 days.

(21) Appl. No.: 09/254,931

(22) PCT Filed: May 14, 1997

(86) PCT No.: PCT/IT97/00112

§ 371 Date: Mar. 17, 1999

§ 102(e) Date: Mar. 17, 1999

(87) PCT Pub. No.: WO98/12104

PCT Pub. Date: Mar. 26, 1998

(30) Foreign Application Priority Data

Sep. 17, 1996 (IT) ..... 96-A/0026

(51) Int. Cl.[7] ..... B63H 1/08

(52) U.S. Cl. ..... 440/93; 416/108; 416/110; 416/111

(58) Field of Search ..... 440/79, 6, 50, 440/93; 114/330; 416/164, 1, 108, 109, 110, 111

(56) References Cited

U.S. PATENT DOCUMENTS

| | | | | |
|---|---|---|---|---|
| 1,823,169 | | 9/1931 | Schneider . | |
| 1,922,606 | * | 8/1933 | Voith | 440/93 |
| 2,190,617 | * | 2/1940 | Von Den Steinen | 440/93 |
| 2,250,772 | * | 7/1941 | Mueller et al. | 440/93 |
| 2,585,502 | * | 2/1952 | Schneider | 440/93 |
| 3,044,434 | * | 7/1962 | Sarchin | 440/93 |
| 3,639,077 | | 2/1972 | Slates . | |
| 3,865,060 | * | 2/1975 | Bastide | 440/93 |
| 4,752,258 | * | 6/1988 | Hochleitner et al. | 440/93 |
| 5,028,210 | | 7/1991 | Peterson et al. . | |
| 5,462,406 | * | 10/1995 | Ridgewell et al. | 416/108 |
| 5,632,661 | * | 5/1997 | Jurgens et al. | 440/93 |

FOREIGN PATENT DOCUMENTS

| | | |
|---|---|---|
| 0221491A | 5/1987 | (EP) . |
| 2099178A | 3/1972 | (FR) . |

* cited by examiner

*Primary Examiner*—S. Joseph Morano
*Assistant Examiner*—Lars A. Olson
(74) *Attorney, Agent, or Firm*—Smith, Gambrell & Russell, LLP

(57) ABSTRACT

A vertical axis and transversal flow nautical propulsor continuously self-orients the blades. The propulsor includes a plurality of blades rotatable about a vertical axis; a blade supporting plate for supporting the blades, wherein the blade supporting plate is rotatable about a vertical axis independent of rotation of the blades; a motor for rotating the blade supporting plate; a motor for each blade, for rotating the blade about its own vertical axis; and a rotatable shaft. The rotatable shaft is supported by a rotor body coupled with the blade supporting plate. A plurality of spindles are provided on the rotatable shaft, wherein the spindles are coaxial with one another and with the rotatable shaft. The number of spindles corresponds to the number of blades, and the spindles are rotatable independent of one another in such a way to allow independent rotation of the relevant blade. The rotatable shaft and the spindles each have an inner end within the rotor body and an outer end outside the rotor body. The inner and outer ends of each of the spindles includes first motion transfer equipment for transferring motion from the relevant electric motor to the relevant rotating blade, and the blade axis and the axis of the relevant electric motor include corresponding second motion transfer equipment for transferring motion to the first motion transfer equipment. An interface unit is provided between an operator and a propulsor electronic control unit, wherein the motors are controllable by the electronic control unit in such a way to adjust a position and an orientation of the relevant blade in order to obtain, for any operative situation, an optimal performance over an entire operative range of the propulsor.

17 Claims, 3 Drawing Sheets

VERTICAL AXIS AND TRANSVERSAL FLOW NAUTICAL PROPULSOR WITH CONTINUOUS SELF-ORIENTATION OF THE BLADES

BACKGROUND OF THE INVENTION

The invention relates to a vertical axis and transversal flow nautical propulsor with continuous self-orientation of the blades.

More particularly, the invention relates to a nautical propulsor of the above kind able to satisfy, in the different operation conditions, the maximum fluid mechanic efficiency.

As is well known, mechanic propulsion by means of horizontal axis propellers is the most common propulsive apparatus, in view of its constructive simplicity and of the many different kinds available and hydrodynamically tested.

However, the use of this kind of apparatus has some unfavorable aspects, that can be summarized as follows:

1) limited optimum range (good efficiency only for specific speeds);
2) creation of visible vortical wakes, and high values for the centrifugal and tangential forces created (reveals the presence of remarkable loss of energy); and
3) penalization of the performances due to the hull effect (high discrepancies of the features of the propeller insulated and mounted on the hull).

The need for reducing these unfavorable aspects leads to the exploration of new, additional or substitute propulsion solutions.

Particularly, in the case of uses requiring a high level of silentness, attention has focused on the development of vertical axis propulsors, having a blade axis perpendicular with respect to the advancement direction. The flow transversely crosses the blade supporting disc and is slightly deviated; the final result on the fluid is not different with respect to the one due to sea mammal anal fins, that instinctively carry out during the motion the same kinematic functions (a result of adaptive evolution in the environment).

During tests carried out within a naval basin on these propulsive systems, aspects came out that directly influence in a determining way the performances of the new kind of propulsor and that remarkably increase its fluid mechanic performances and its flexibility.

Among the most important, the following can be mentioned: a formation effect between the blades; the number of the blades; the maximum impact angles; the ratio between the orbital ray of the blade supporting disc and the maximum chord of the blade; the chord to blade lengthening ratio; and the configuration of the hydrodynamic profile of the blade.

A first type of vertical blade propulsor is shown in U.S. Pat. No. 1,823,169, which discloses a vertical blade propulsor in which the head motors move fixedly with the rotor plate.

The vertical axis propulsors presently known have a plurality of blades, rotating upon themselves, supported by a rotating disc, the motion of the rotating disc and the rotation of the blade being due to a single motor and to a mechanical linkage assembly. An example of such propulsors is disclosed in FR-A-2 099 178.

Generally speaking, the control of the blade orientation is operated by mechanical kinematisms on the bases of angular positioning curves having an established shape an fixed during the rotation.

Furthermore, the blades are characterized by a symmetrical profile which does not allow one to obtain an optimum efficiency for any position and situation that could be encountered.

Moreover, in view of their intrinsic features, the known vertical axis propulsors cannot be employed for immersion naval means.

The known vertical axis propulsors are of the cycloidal or trocoidal kind.

SUMMARY OF THE INVENTION

In this framework, there is provided the solution according to the present invention that solves all the above mentioned drawbacks, it being possible to always provide, under different operating conditions, the maximum fluid mechanic efficiency.

The solution suggested according to the present invention allows one to independently rotate each blade, with defined angles, about its axis during its rotation about the vertical axis.

It is therefore suggested, according to the present invention, to provide a vertical axis nautical propulsor (i.e., a propulsor having the axis of the bearing surfaces perpendicular with respect to the advancement direction), to be used either on surface means or immersion means, wherein the characterizing and innovative element is the way of controlling the orientation of the blades along the orbital motion of the blade bearing disc, and the ability of the propulsor to self-program according the maximum fluid mechanic efficiency criteria.

The propulsor according to the present invention is versatile within the whole speed range from a fixed point, typically when the craft is started (high thrust in a stationary position and during towing operations), up to high speed, in correspondence of which, in view of the obtainable configuration, the efficiencies are higher than those of known propulsors.

With respect to traditional propellers and to azimuthal propulsors, the solution according to the present invention allows one to orient on 360° the thrust obtained, which also allows one to execute at the same time the steering action.

Furthermore, the solution according to the invention is realized in such a way to avoid any cavitation problem on the blades, and thus it is characterized by a longer life than traditional propellers.

It is therefore a specific object of the present invention to provide a vertical axis and transversal flow nautical propulsor with continuous self-orientation of the blade comprising a plurality of blades, rotatable about a vertical axis and supported by a blade supporting plate, also the plate is rotatable about a vertical axis independently with respect to the rotation of the single blades, characterized in that the propulsor further comprises a motor for rotating the blade supporting plate, a fixed pulse electric motor for each blade, for rotating each of the blades about its own vertical axis, a rotating shaft, supported by a motor body coupled with the blade supporting plate, upon which spindles are provided, coaxially one with respect to the other and with respect to the shaft, and independently rotatably coupled with the rotating shaft, the number of the spindles corresponding to the number of the single blades, the spindles rotating independently one with respect to the others in such a way to allow the rotation of the relevant blade independently with respect to the others, the rotating shaft, and the spindle, having one end within the rotor body and one end outside the rotor body, wherein the inner and outer ends of each of the spindles includes first motion transfer means to transfer the motion from the relevant electric motor to the relevant rotating blade, wherein on the blade axis and on the axis of the relevant electric motor corresponding motion transfer means are provided, to transfer the motion to the first motion transfer means, and one interface unit between the operator and a propulsor control electronic unit, the electric motors being controlled by said electronic control unit in such a way to adjust the position and the orientation of the relevant blade in order to obtain for any operative situation the best performances for the whole operative range.

Preferably, according to the invention, between each fixed electric pulse motor and the relevant transmission motion means an electro-hydraulic unit is provided.

Still according to the invention, at least three blades are provided, preferably between four and seven blades, still more preferably five or seven, although it is possible to provide a higher number of blades.

According to the invention, the blades have an asymmetrical profile.

The transmission means will be preferably comprised of means guaranteeing a substantially null sliding effect.

Particularly, the motion transfer means could be comprised of a first toothed pulley, provided on the axis of the relevant electric motor or hydraulic unit, a second toothed pulley, supported by the relevant spindle, on the outer portion of the rotating shaft with respect to the rotor body, the pulleys being connected with each other by a positive drive belt or a chain, a third toothed pulley, supported by the relevant spindle, on the end inside the rotor body, and a fourth pulley supported by the axis of the rotating blade, the third and fourth toothed pulleys being coupled by a second positive drive belt or a second chain.

Preferably, the transmission ratio among the various means is 1:1.

Furthermore, according to the invention, the electric pulse motors are stepping motors.

Still according to the invention, sensors and/or transducers to reveal the advancement speed of the vehicle, the rotary speed of the blade supporting plate and the position of the blades with respect to the rotor body can be provided.

Furthermore, according to the invention, the motor operating the blade supporting plate and the rotor body can be of the electric or thermal kind.

BRIEF DESCRIPTION OF THE DRAWINGS

The present invention will be now described, for illustrative but not limitative purposes, according to its preferred embodiments, with particular reference to the figures of the enclosed drawings, wherein.

DETAILED DESCRIPTION OF THE INVENTION

In the enclosed drawings, an embodiment of a propulsor according to the invention providing five rotating blades is shown.

It must however be borne in mind that the number of blades, as well as their dimensions, can be varied, without departing from the scope of the present invention.

Referring now to the enclosed FIGS. 1–3, the structure and the operation of an embodiment of a naval propulsor according to the invention will be described.

Figure 1:
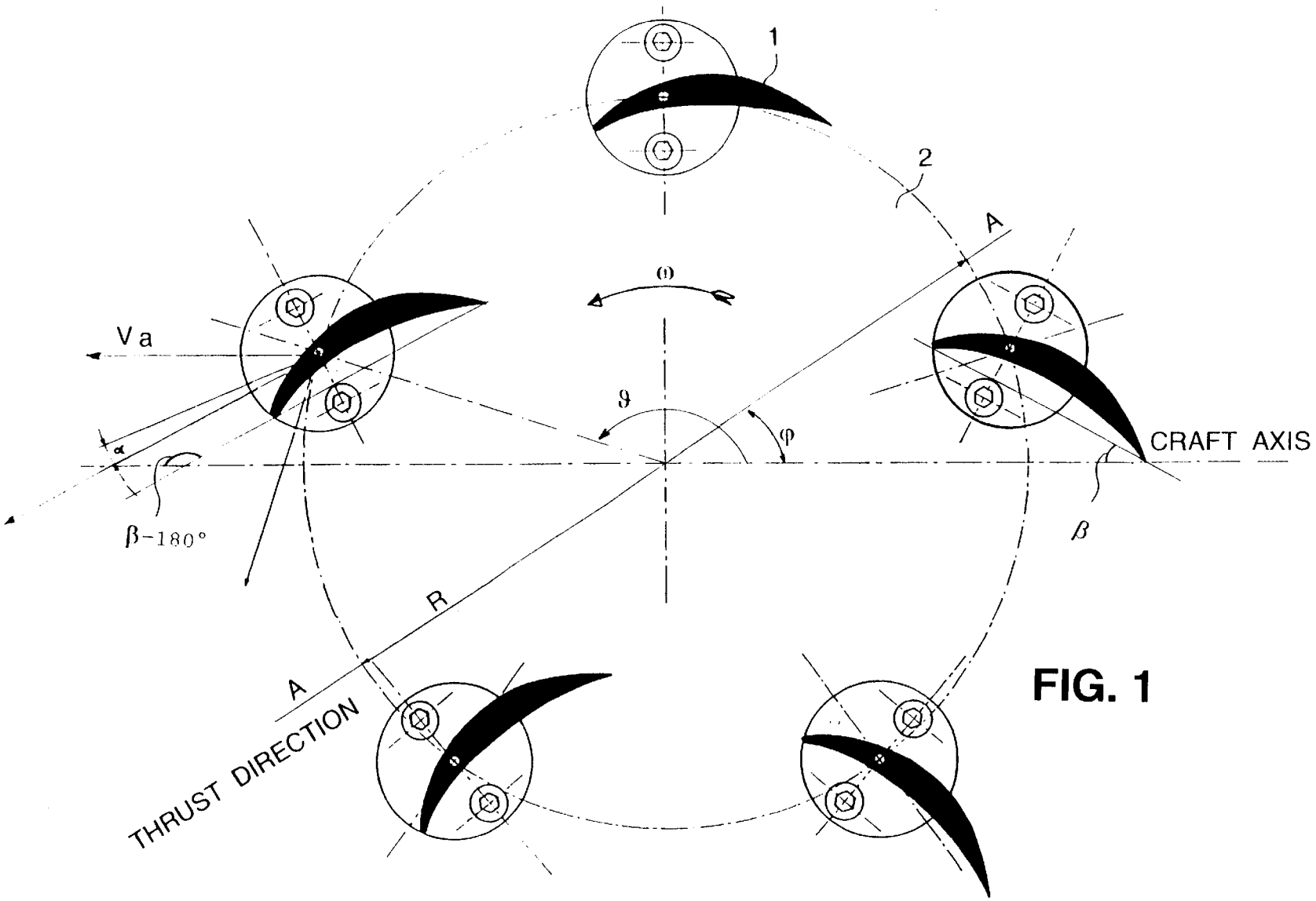
FIG. 1 diagrammatically shows the motion of the blades of an embodiment of a nautical propulsor according to the invention.

In FIG. 1, an operation scheme of the blades 1, specifically five blades, is shown, wherein the blades 1 are equally spaced along the circumference of the blade supporting plate 2, the plate 2 rotating with the angular velocity $\omega$.

The blade 1 orientation laws will be described later.

As can be noted in FIG. 1, the blade 1 profile is asymmetrical and has a curvature on both the inner and outer surface, which allows the propulsor system to obtain continuous self orientation with maximum fluid mechanic efficiency in any situation, thus obtaining a system able to satisfy the needs imposed by the fluid mechanic optimization criteria, versatile under the kinematic aspect and reliable under the mechanical aspect (absence of leverages, of translating parts, etc.) for long duration use and low maintenance for naval means.

Figure 2:
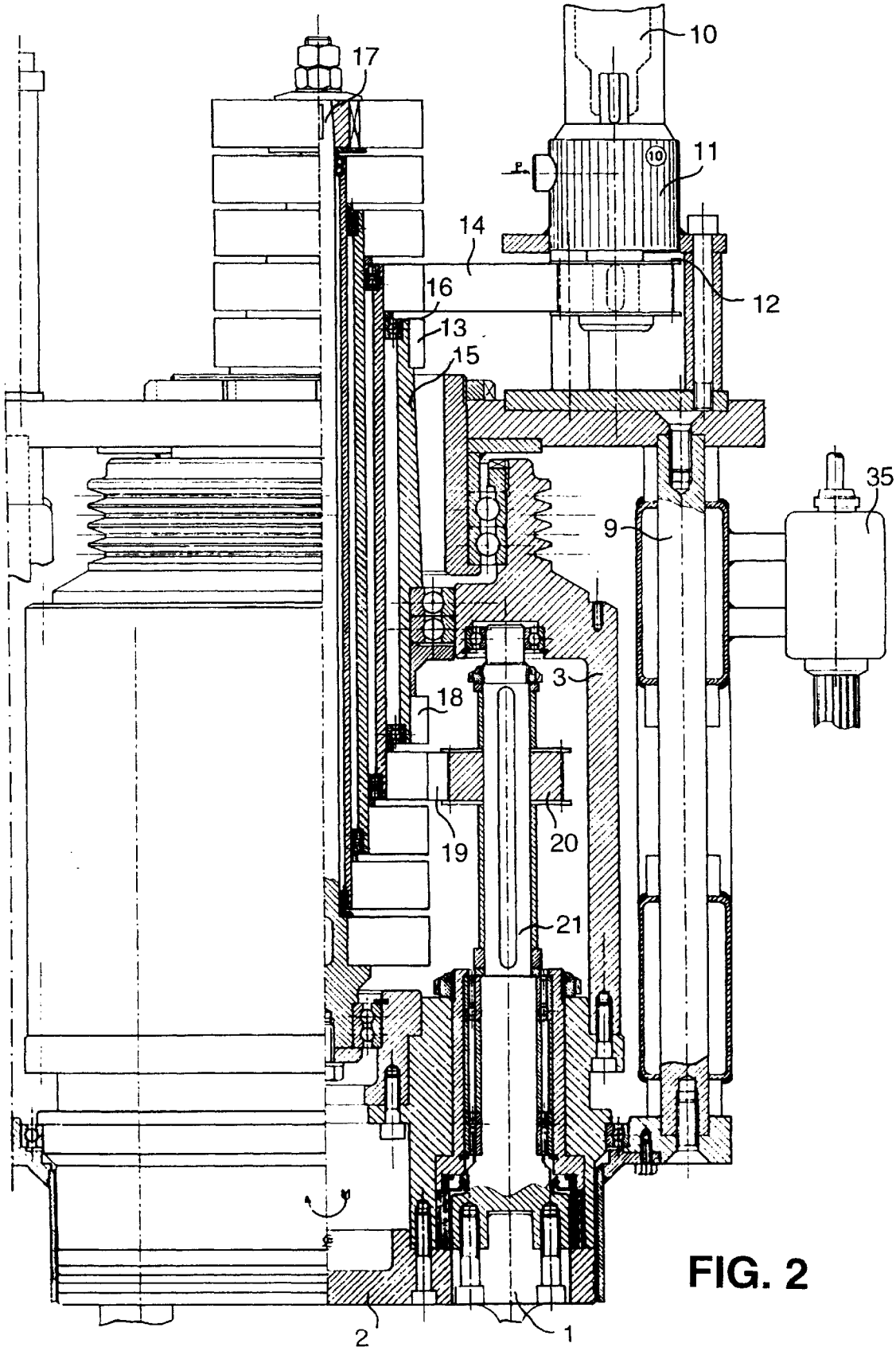
FIG. 2 is a partially sectioned lateral view of an embodiment of a naval propulsor according to the invention.

Observing now particularly FIG. 2, it can be noted the structure of a propulsor according to the teachings of the present invention.

The blade supporting plate 2 rotates along with a rotary body 3 by the action of a motor 4 (see FIG. 3), by the interposition of a positive drive belt 5 placed between two pulleys 6 and 7.

Each one of the blades 1 is coupled to the plate 2 by a projection and screws.

Electro-hydraulic units 10–11 are mounted on the fixed frame 9 in a number corresponding to the number of the blades 1.

The electro-hydraulic units constitute the fixed part of the system and are comprised of the pulse electric motors 10 driving the relevant hydraulic units 11.

A toothed gear 12 supported on the lower part of the electro-hydraulic unit 10–11 is coupled by positive drive belt 14 to a further toothed gear 13, which is supported by a vertical spindle 15 rotating about the vertical shaft 17 through bearings 16.

The vertical shaft 17 supports a corresponding toothed wheel 18 which is coupled by the belt 19 to a toothed gear 20 integral with the blade rotation spindle 21.

In this way, the fixed unit 10–11 rotates the blade 1 upon its own axis, the blade 1 at the same time is free to rotate together with the plate 2 of the body 3.

Each of the units 10–11 for each of the blades 1 provides a transmission system similar to the one described, with relevant toothed gears 13 and 18 supported by coaxial spindles, all independently rotating about the axis 17.

Figure 3:
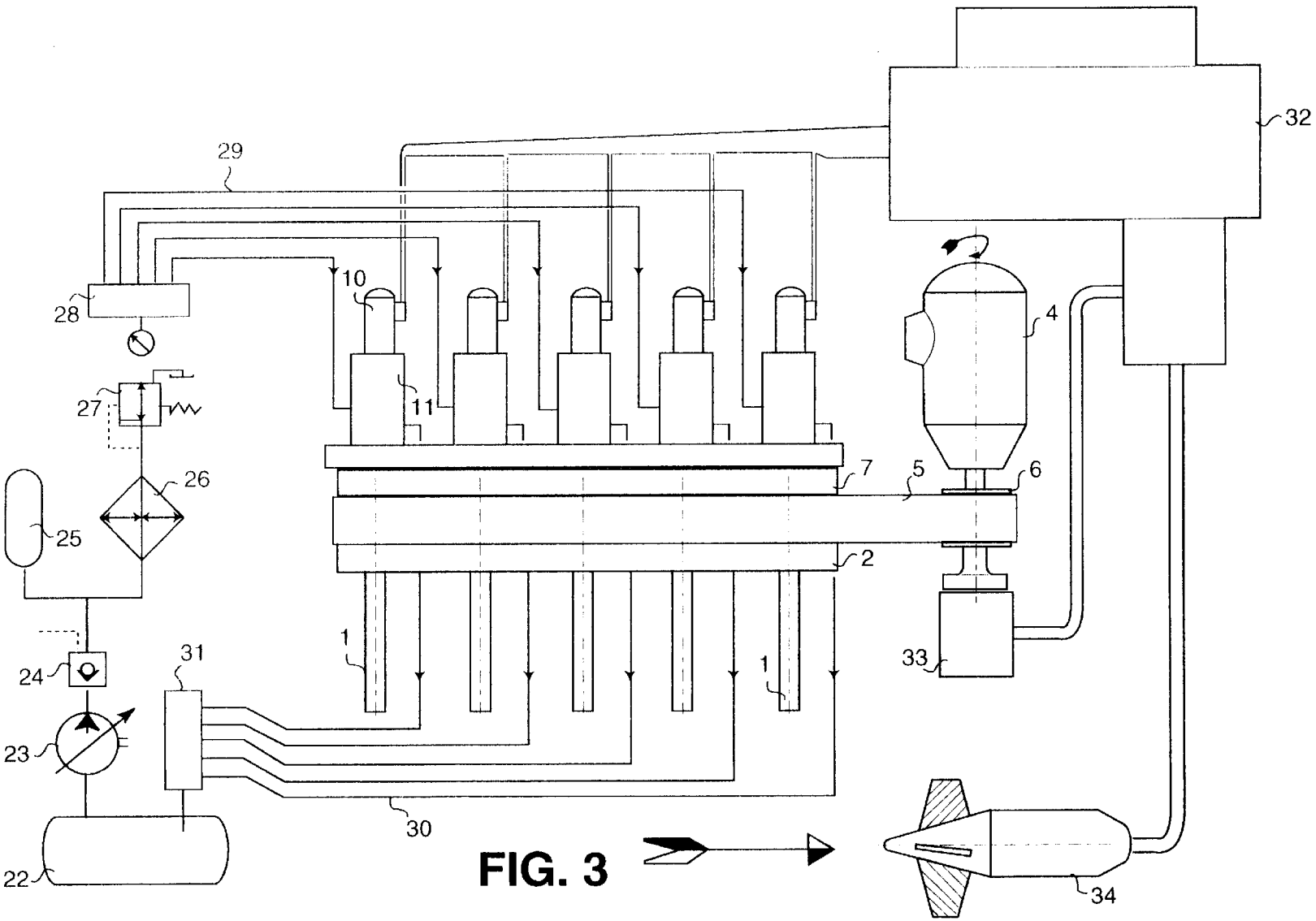
FIG. 3 is a diagram of the electro-hydraulic circuit controlling a naval propulsor according to the invention.

Making specific reference to FIG. 3, the electro-hydraulic circuit of the preferred embodiment of the invention substantially comprises the following parts:

- a tank 22 containing oil (or a different fluid having suitable properties as to viscosity, low compressibility, and high operative temperature);
- a variable flow rate pump 3;
- a controlled check valve 24;
- an oleodynamic group 25 for adjusting the fluid pressure;
- a heater/heat exchanger 26;
- a controlled safety bi-directional valve 27;
- a distributor 28;
- inlet tubes 29, in a number corresponding to the number of blades 1;
- an electro-hydraulic actuator 11 for each blade 1;
- return tubes 30 for the actuators 11;
- a manifold 31;
- an electric or endothermic motor 4;

a blade supporting plate 2, rotated by the motor 4;

a control electronic unit 32 for the system;

an angular velocity sensor 33 for the plate 2;

a propulsor advancement speed sensor 34; and a stepping motor 10 for each of the actuators 11.

The variable flow rate pump 23 intakes oil from the tank 22 and sends it to the distributor 28. The controlled check valve 24 prevents flow in the opposite direction. The oleodynamic group 25 and the heater/heat exchanger 26 maintain the pressure and the temperature of the oil constant, respectively, in the portion of the hydraulic circuit between the valve 24 and the actuators 11. Particularly, the heater/heat exchanger 26 heats the oil at the start of the propulsor, to reach the optimum operative temperature, and subtracts heat from the oil during the running operation. The controlled check bidirectional valve 27 controls variations of the flow rate required by the downstream circuit. The distributor 28 sends the oil to the inlet tubes 29 connecting with the electro-hydraulic actuators 11. Each one of the actuators 11 orients the corresponding blade 1. The oil is then sent to the return tubes 30 of the actuators 11 toward the manifold 31, and finally returns to the tank 22. The movement of each of the actuators 11 and consequently of the corresponding blade 1 is controlled by the relevant stepping motor 10.

Driving signals for each of the stepping motors 10 come from the system control electronic unit 32, which processes the orientation of blades 1 for optimizing fluid mechanic efficiency of the propulsor every time as a function of signals coming from sensors 33 and 34 and position transducer 35.

System control electronic unit 32 includes essentially a set of electronic boards, in a number corresponding to a number of the blades 1, each one controlling the stepping motor 10 relevant to a blade 1, and one electronic board for the global managing of the system electronics. Each of the blade control boards is substantially composed by the following components:

eventually, one (or more) central processing unit, as, for instance, a DSP (Digital Signal Processor);

eventually, one (or more) non-volatile memory storing the program to be executed by the central processing unit;

eventually, one (or more) volatile memory for storing temporary processing data;

an input/output interface for communicating with the system electronics global management board;

devices for generating signals to drive and/or to communicate with the stepping motor and to communicate with the system electronics global management board;

an input/output interface for adapting driving signals and/or for communicating control signals and operation monitoring signals to the stepping motor 10; and complementary circuitry, as, for instance, a voltage supply regulator circuit and a clock circuit.

The system electronics global management board is substantially composed by the following components:

one (or more) central processing unit, as, for instance, a DSP (Digital Signal Processor);

one (or more) non-volatile memory storing the program to be executed by the central processing unit;

one (or more) volatile memory for storing temporary processing data;

an input/output interface or communicating with the blade control electronic boards;

an input/output interface for adapting signals coming from sensors 33 and 34 and position transducer 35 and/or for communicating control signals and operation monitoring signals to sensors 33 and 34 and transducer 35 and/or to the electric or thermic motor 4;

an input/output interface for connecting to devices communicating with the operator, in order, for instance, to display propulsor operation characteristic data, to receive information about the required thrust direction and to switch from automatic to manual operation and vice versa; and complementary circuitry, as, for instance, a voltage supply regulator circuit and a clock circuit.

The program executed by system control electronic unit 32 is based on a processing algorithm implementing blade orientation laws for providing optimal fluid mechanic efficiency of the propulsor every time. The laws are described in the following, referring to FIG. 1.

Vertical axis propulsors are characterized by the route described in the space by the blade axes, during the motion resulting from the composition of their rotation around the rotor main axis with the advancement translation of the rotor main axis. The route is defined according to the ratio $\Lambda$ of advancement speed $V_a$ to radial velocity of the blade axes corresponding to an angular velocity $\omega$ of rotation of the blade supporting disc 2, wherein R is the distance between blade axes and rotor main axis ($\Lambda=V_a/\omega R$).

A second parameter characterizing vertical axis propulsor fluid mechanic operation is the angle wherewith blades 1 meet fluid during motion, which will be in the following referred to as the leading angle $\alpha$. A quantity functionally depending on the leading angle $\alpha$, which can be considered instead of $\alpha$ for characterizing vertical axis propulsor fluid mechanic operation, is the blade angle $\beta$, defined as the angle between the line connecting the leading and trailing edges of the blade supporting disc 2 and the blade contour chord line.

For each blade 1, the value of the leading angle $\alpha$, and consequently the value of the aforesaid blade angle $\beta$, corresponding to propulsor maximum fluid mechanic efficiency, functionally depends on three parameters: the angle $\theta$, locating the blade axis position in polar co-ordinates; the value $\Lambda$; the angle $\phi$, locating propulsor thrust direction relative to the longitudinal axis of the water-(or underwater-) craft, which can be referred to the aforementioned polar co-ordinates. The values of the two parameters $\Lambda$ and $\phi$ are common to all functions providing the value of the leading angle $\alpha$ (or the value of the blade angle $\beta$) for each blade 1; instead, the value of the parameter $\theta$ varies for each blade 1, considered in the same polar co-ordinates, and it can be obtained through one position transducer 35 from which it is possible to compute the position of each blade 1 by simply adding an offset for each blade 1. The program, executed by system control electronic unit 32, computes in every moment, determined by the clock signal, the value of the leading angle $\alpha$ (or the value of the blade angle $\beta$), corresponding to propulsor maximum fluid mechanic efficiency, either computing the function through which it depends on instantaneous values of the parameters ($\theta$, $\Lambda$ and $\phi$), or reading, in a non-volatile memory, the value a stored in a location the address of which depends on instantaneous values of the parameters ($\theta$, $\Lambda$ and $\phi$), this address dependence being implementable, for instance, through an encoder.

The value $\Lambda$ is optimized for every value $V_a$, modifying suitably the value of the angular velocity $\omega$ of rotation of the blade supporting disc 2, corresponding to propulsor maximum fluid mechanic efficiency. The program, executed by system control electronic unit 32, computes in every moment, determined by the clock signal, the value of angular velocity ω of rotation of the blade supporting disc 2 and, consequently, the value Λ, corresponding to propulsor maximum fluid mechanic efficiency, either computing the function through which it depends on instantaneous value of the parameter $V_a$, or reading, in a non-volatile memory, the value ω stored in a location the address of which depends on instantaneous value of the parameter $V_a$, this address dependence being implementable, for instance, through an encoder.

Therefore, the program executed by system control electronic unit 32 consists, substantially, of the following steps:

receiving, as input data, the value of the angle θ locating blade axis position, resulting from processing the signal coming from transducer 35, the value of angular velocity ω of rotation of the blade supporting disc 2, coming from sensor 33, the value of advancement speed $V_a$ of rotor main axis, coming from sensor 34, and the value of angle ϕ, locating propulsor thrust direction relative to the longitudinal axis of the water-(or underwater-) craft, coming from suitable devices for communicating with the operator;

computing the value of angular velocity ω of rotation of the blade supporting disc 2, and, consequently, the value Λ, corresponding to propulsor maximum fluid mechanic efficiency, depending on the value of advancement speed $V_a$;

computing the value of leading angle α (or the value of the blade angle β), corresponding to propulsor maximum fluid mechanic efficiency, depending on the values of angle θ, locating blade axis position, of ratio Λ (processed) and of angle ϕ, locating required propulsor thrust direction;

transmitting an appropriate control signal to the relevant stepping motor 10 for orienting the blade 1 according to the computed leading angle α (or blade angle β); and transmitting an appropriate control signal to the electric or thermic motor 4 for matching the angular velocity ω of rotation of the blade supporting disc 2 with the computed value.

It is evident that, even in the case of the presence of central processing units on the blade-control boards, processing common to all blades 1, as for computing angular velocity ω, can be executed by the system electronics global management board.

The program also provides appropriate functions for modulating ω (and Λ) and, consequently, α under acceleration and deceleration phases of the water-(or underwater-) craft.

The toothed wheels 13 within the rotor body 3 rotate the planetary gears 20 of the relevant blade supporting spindles 21.

The rotor body 3 acting as blade supporting disc 2 is rotated by the outer motor 4 (electric or thermal motor). The synchronism of the relevant positions between blade supporting disc 2 and the orientation angle of each blade I is very important for the performance of the propulsor.

The advancement speed of the craft will determine the most suitable rotary speed of the rotor and the best geometrical layout of the blades 1 within the orbital plane for each moment. Asymmetrical routes will be obtained that cannot be obtained by any mechanical system.

The propulsor, within the whole speed range, from the fixed point, for the towing situation, up to the maximum speed possible for the craft, constantly operates with maximum efficiency conditions and at the same time carries out the propulsion and control functions by a simple, sturdy apparatus, and because the power is available on a different axis, it is possible to obtain exceptional maneuverability conditions for any kind of craft.

The present invention has been described for illustrative but not limitative purposes, according to its preferred embodiments, but it is to be understood that modifications and/or changes can be introduced by those skilled in the art without departing from the relevant scope as defined in the enclosed claims.

I claim:

1. Vertical axis and transversal flow nautical propulsor with continuous self-orientation of the blades, comprising: a plurality of blades rotatable about a vertical axis; a blade supporting plate for supporting the plurality of blades wherein said blade supporting plate is rotatable about a vertical axis independently with respect to rotation of the blades; a motor for rotating said blade supporting plate; a fixed pulse electric motor for each blade, for rotating said blade about its own vertical axis; a rotatable shaft; a rotor body supporting the rotatable shaft and coupled with said blade supporting plate; a plurality of spindles provided on the rotatable shaft, wherein the spindles are coaxial one with respect to the others and with respect to said rotatable shaft, and independently rotatably coupled with said rotatable shaft, wherein the number of said spindles corresponds to the number of the blades, said spindles being rotatable independently one with respect to the others in such a way to allow rotation of the relevant blade independently with respect to the others, said rotatable shaft and the spindles each having an inner end within said rotor body and an outer end outside said rotor body, wherein said inner and outer ends of each of the spindles includes first motion transfer means for transferring motion from the relevant electric motor to the relevant rotating blade, wherein the blade axis and the axis of the relevant electric motor include corresponding second motion transfer means for transferring motion to said first motion transfer means; and an interface unit between an operator and a propulsor electronic control unit, wherein said electric motors are controllable by said electronic control unit in such a way to adjust a position and an orientation of the relevant blade in order to obtain for any operative situation, an optimal performance over an entire operative range of the propulsor.

2. Nautical propulsor according to claim 1, further including an electro-hydraulic unit provided between each fixed electric pulse motor and the relevant second motion transfer means.

3. Nautical propulsor according to claim 1, wherein at least three blades are provided.

4. Nautical propulsor according to claim 1, wherein said blades have an asymmetrical profile.

5. Nautical propulsor according to claim 1, wherein said first and second motion transfer means include means guaranteeing a substantially null sliding effect.

6. Nautical propulsor according to claim 2, wherein said first and second motion transfer means include: a first toothed pulley, provided on the axis of the relevant electric motor or hydraulic unit; a second toothed pulley, supported by the relevant spindle, on the outer end of the rotating shaft, said first and second toothed pulleys being connected to each other by a drive belt or a chain; a third toothed pulley, supported by the relevant spindle, on the inside end thereof; and a fourth pulley supported by the axis of the rotating blade, said third and fourth toothed pulleys being coupled by a second drive belt or a second chain.

7. Nautical propulsor according to claim 1, wherein a transmission ratio among the first and second motion transfer means is 1:1.

8. Nautical propulsor according to claim 1, wherein said electric pulse motors are stepping motors.

9. Nautical propulsor according to claim 1, further including sensors and/or transducers to reveal an advancement speed of a vehicle driven by the nautical propulsor, a rotary speed of the blade supporting plate, and a position of the blades with respect to the rotor body.

10. Nautical propulsor according to claim 1, wherein said motor operating the blade supporting plate and the rotor body is an electric motor or a thermal motor.

11. Nautical propulsor according to claim 1, wherein said electronic control unit provides one blade control board for each of said blades and one electronic board for global managing the system electronics.

12. Nautical propulsor according to claim 11, wherein each of said blade control boards includes:

an input/output interface for communicating with said electronic board for system electronics global managing;

devices for generating signals to drive and/or to communicate with the fixed pulse electric motor and to communicate with said electronic board for system electronics global managing;

an input/output interface for adapting driving signals and/or for communicating control signals and operation monitoring signals to the fixed pulse electric motor; and complementary circuitry, including a voltage supply regulator circuit and a clock circuit.

13. Nautical propulsor according to claim 12, wherein each of said blade control boards further includes:

at least one central processing unit, including a digital signal processor;

at least one non-volatile memory for storing a program to be executed by said central processing unit; and at least one volatile memory for storing temporary processing data.

14. Nautical propulsor according to claim 11, wherein said electronic board for global managing the system electronics includes:

at least one central processing unit, including a digital signal processor;

at least one non-volatile memory for storing a program to be executed by said central processing unit;

at least one volatile memory for storing temporary processing data;

an input/output interface for communicating with said blade control electronic boards;

an input/output interface for adapting signals coming from sensors and a position transducer and/or for communicating control signals and operation monitoring signals to the sensors and the transducer and/or to the motor for rotating the blade supporting plate;

an input/output interface for connecting to devices communicating with the operator to display propulsor operation characteristic data, to receive information about a required thrust direction, and to switch from automatic to manual operation and vice versa; and complementary circuitry, including a voltage supply regulator circuit and a clock circuit.

15. Nautical propulsor according to claim 1, wherein said electronic control unit:

receives, as input data, a value of an angle ($\theta$) locating the blade axis position, resulting from processing of signals coming from a transducer, a value of angular velocity ($\omega$) of rotation of the blade supporting plate, coming from a first sensor, a value of advancement speed ($V_a$) of rotor main axis, coming from a second sensor, and a value of angle ($\phi$) locating propulsor thrust direction relative to a longitudinal axis of a water-craft or an underwater-craft to which the propulsor is attached, coming from devices for communicating with an operator;

computes said value of angular velocity ($\omega$) of rotation of the blade supporting plate and, consequently, a value ($\Lambda$), corresponding to propulsor maximum fluid mechanic efficiency, depending on the value of advancement speed ($V_a$);

computes a value of a leading angle ($\alpha$) or a value of the blade angle ($\beta$), corresponding to propulsor maximum fluid mechanic efficiency, depending on the values of angle ($\theta$), locating blade axis position, of ratio ($\Lambda$) and of angle ($\phi$), locating required propulsor thrust direction;

transmits appropriate control signals to the relevant fixed electric pulse motor for orienting the blade according to the computed leading angle ($\alpha$) or blade angle ($\beta$); and transmits appropriate control signals to the motor rotating the blade supporting plate to match the angular velocity $\omega$ of rotation of the blade supporting plate with the computed value.

16. Nautical propulsor according to claim 3, wherein the propulsor includes four to seven blades.

17. Nautical propulsor according to claim 3, wherein the propulsor includes five or seven blades.

* * * * *